United States Patent [19]

Sheridan et al.

[11] 4,300,114

[45] Nov. 10, 1981

[54] MANUALLY ADJUSTABLE RESISTOR DEVICE

[75] Inventors: John J. Sheridan, Middletown; Willis H. Anderson, Anderson, both of Ind.

[73] Assignee: General Motors Corporation, Detroit, Mich.

[21] Appl. No.: 114,709

[22] Filed: Jan. 23, 1980

[51] Int. Cl.[3] ..... H01C 10/36

[52] U.S. Cl. ..... 338/172; 338/198

[58] Field of Search ..... 338/172, 163, 164, 179, 338/198, 200, 184

[56] References Cited

U.S. PATENT DOCUMENTS

| | | | |
|---|---|---|---|
| 3,123,795 | 3/1964 | Bender | 338/172 |
| 3,161,850 | 12/1964 | Klug | 338/195 |
| 3,576,510 | 4/1971 | Bruder | 338/150 |
| 3,846,731 | 11/1974 | Dumas et al. | 337/127 |
| 3,886,514 | 5/1975 | Oka | 338/126 |
| 3,916,369 | 10/1975 | Minami et al. | 338/172 |

FOREIGN PATENT DOCUMENTS

| | | | |
|---|---|---|---|
| 1506394 | 4/1978 | United Kingdom | 338/172 |

*Primary Examiner*—C. L. Albritton
*Attorney, Agent, or Firm*—Warren D. Hill

[57] ABSTRACT

A thumbwheel actuated variable resistor device has a housing comprising a substrate carrying a resistor pattern and a cover with electrical terminals embedded therein and a thumbwheel in the space between the substrate and cover. The thumbwheel carries a pair of conductors which extend from opposite sides thereof to selectively engage portions of the resistor circuit and the terminals so that the resistance between the terminals depend on the thumbwheel position.

4 Claims, 6 Drawing Figures

MANUALLY ADJUSTABLE RESISTOR DEVICE

This invention relates to a manually adjustable resistance and more particularly to a thumbwheel controlled variable resistor device.

In order to manually control the intensity of lights in an automotive instrument panel, for example, it is desired to provide a dimming control which is compact, inexpensive and able to dissipate the heat generated therein without substantial deterioration. It is further desirable to include in such a dimming control a switch for controlling another circuit such as a vehicle courtesy light circuit.

It is, therefore, a general object of the invention to provide an improved variable resistance which has a manually controlled resistance value and which is suitable for use in a light circuit. It is a further object to provide such a resistance control combined with a switch for controlling an additional circuit.

The invention is carried out by providing an insulating substrate carrying a resistor circuit which substrate along with a cover forms a housing containing a thumbwheel, terminals embedded in the cover, and conductors carried by the thumbwheel which selectively connect portions of the resistor circuit to the terminals such that the resistance between the terminals is determined by the thumbwheel position. The invention further contemplates an additional pair of terminals embedded in the cover and a bridging conductor on the thumbwheel for selectively engaging the terminals to perform a switching function.

The above and other advantages will be made more apparent from the following specification taken in conjunction with the accompanying drawings wherein like reference numerals refer to like parts and wherein.

Figure 3:
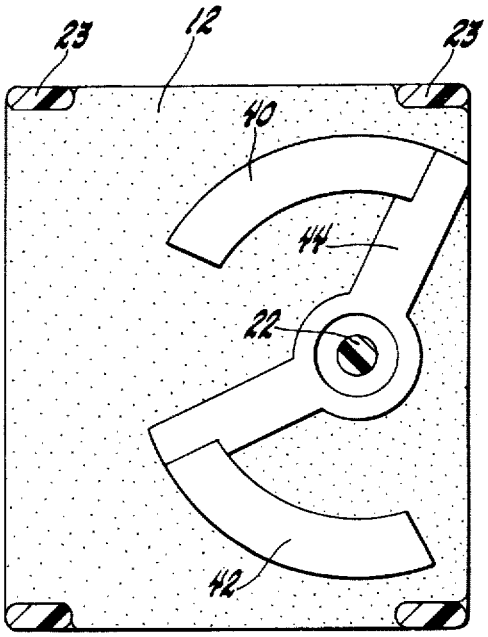
FIG. 3 is an elevational view of a substrate of the device taken along lines 3—3 of FIG. 2 showing one embodiment of the printed resistor circuit thereon.
Figure 4:
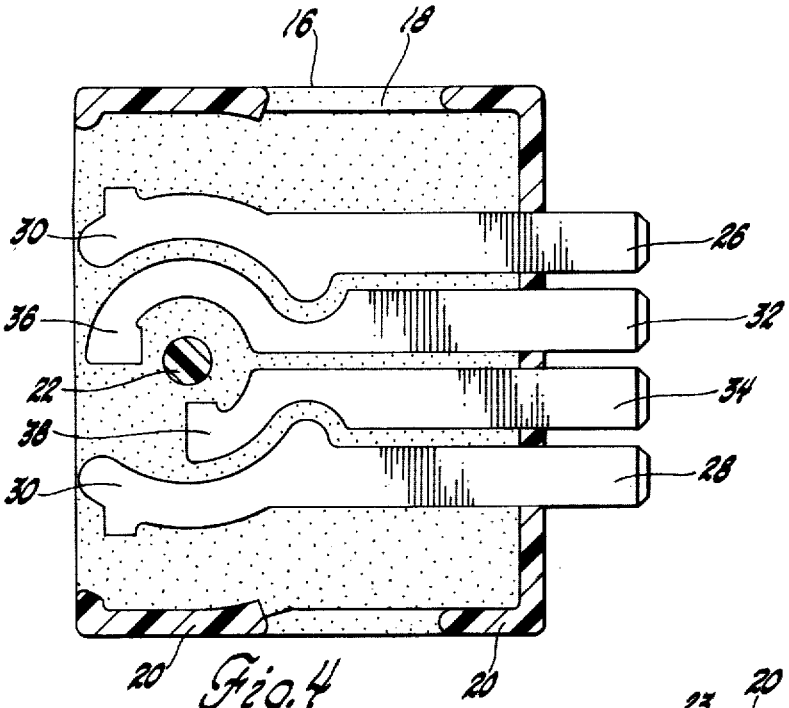
FIG. 4 is an elevational view of the cover of the device taken along lines 4—4 of FIG. 2 showing the terminals carried thereby.

As shown in FIGS. 1-5, the potentiometer comprises a housing 10 comprising an alumina substrate 12 provided with a set of external fins 14 for dissipating heat from the substrate, a cover 16 having an inner face 18 spaced from the substrate 12 by integral wall portions 20, a rivet 22 securing the cover 16 to the substrate 12 and a thumbwheel 24 disposed between the inner surface 18 of the cover and the substrate 12 is rotatably mounted on the rivet 22. Four corner posts 23 extend from the cover to embrace corner notches in the substrate 12. Both the cover and the thumbwheel are formed of a plastic molding material and each of them carry conductive elements which are insert molded in place. The cover 16, as best shown in FIG. 4, has the insert molded conductors which comprise four terminals each of which extends outside the housing 10 for connection to external circuitry and each of which lies flush with the inner face 18 of the cover to expose a contact surface. A pair of outer terminals 26 and 28 include arcuate contact surface portions 30 which lie on opposite sides of the rivet 22 and are concentric therewith. An inner pair of connectors 32 and 34 also terminate in arcuate contact surface portion 36 and 38 respectively with the portion 36 being longer than the portion 38, those portions also being concentric with the rivet 22.

The inner face of the aluminum substrate as best seen in FIG. 3 has two arcuate printed resistors 40 and 42 thereon concentric with the rivet 22 with the right end of the resistor 40 connected to the left end of the resistor 42 by a copper printed conductor 44.

Figure 1:
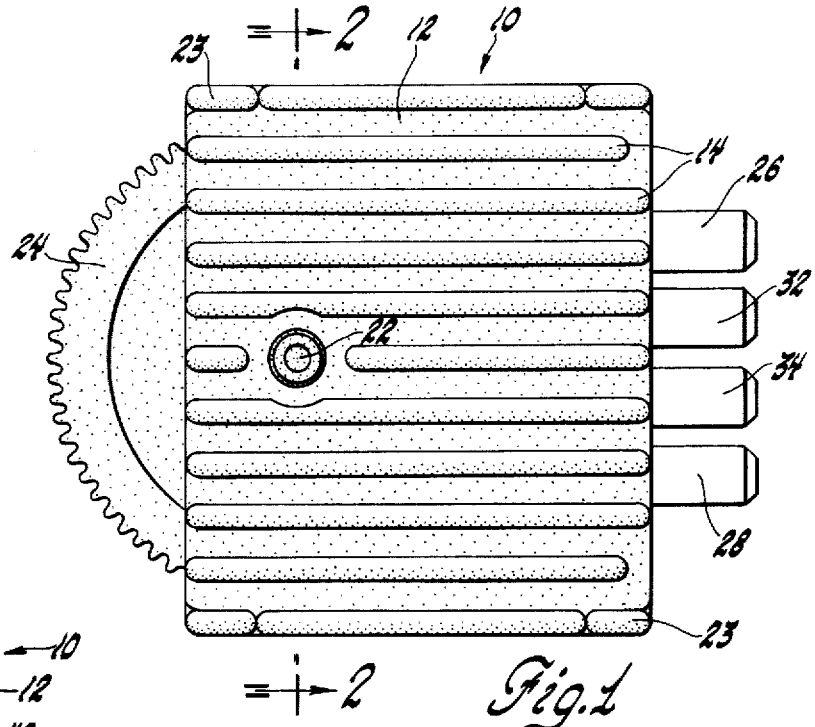
FIG. 1 is an elevational exterior view of a thumbwheel controlled variable resistor device according to the invention.
Figure 2:
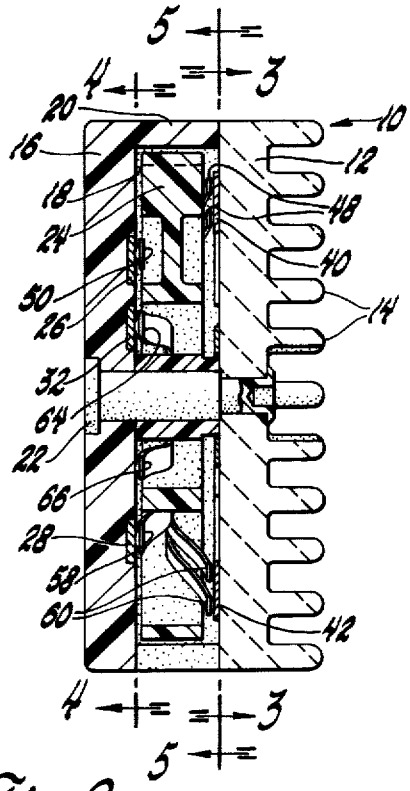
FIG. 2 is a cross-sectional view of the device of FIG. 1 taken along lines 2—2 thereof.
Figure 5:
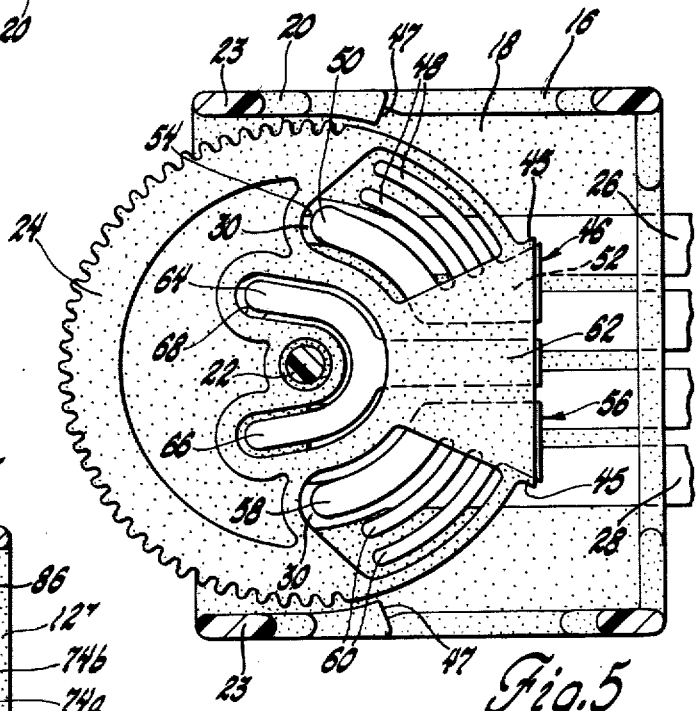
FIG. 5 is an elevational view of the device taken along lines 5—5 of FIG. 2, showing the thumbwheel and cover.

The thumbwheel, as best shown in FIGS. 1 and 5, is essentially circular and has a knurled outer periphery along the extent of the thumbwheel which is exposed outside the housing upon thumbwheel rotation. A pair of limit stops 45 extending radially beyond the nominally circular perimeter of the thumbwheel cooperate with shoulders 47 on walls so to limit the extent of rotational movement of the thumbwheel. A plurality of spring-like contactor elements formed of tin-brass are carried by the thumbwheel. The first contactor element 46 has a pair of small spring fingers 48 and a large spring finger 50. The fingers are all formed integrally with a common root portion 52 which is molded into the body of the thumbwheel. An opening 54 is formed in the thumbwheel to allow the fingers 48 and 50 to curve outwardly towards the substrate 12 and the cover 16 respectively. The fingers 48 are curved into contact with the resistor 40 for sliding engagement therewith upon thumbwheel rotation. The finger 50, on the other hand, is curved in the other direction to make a sliding contact with the surface 30 of the terminal 26. A contactor 56 symmetrical to the contactor 46 and carried by the thumbwheel has a finger 58 which is curved to form a sliding pressure contact with the surface 30 of the terminal 28 and a pair of fingers 60 are curved to make sliding pressure contact with the resistor 42. The thumbwheel is arranged to rotate in one direction far enough that the fingers 48 and 60 would engage portions of the conductor 44 adjacent the ends of the resistors40 and 42 to affect a direct electrical connection between the terminals 26 and 28. When the thumbwheel is rotated from that position to cause the fingers 48 and 60 to move across the resistors, the resistance between the terminals 26 and 28 increases. The other extreme limit of the thumbwheel movement allows the fingers 48 and 60 to move beyond the ends of the resistors to rest on the substrate 12 thereby effecting an open circuit between the terminals 26 and 28.

A Y shaped contactor 62 has its leg portion molded into the thumbwheel and its finger portions 64 and 66 extending into an opening 68 in the thumbwheel partially surrounding the center of the thumbwheel. The fingers 64 and 66 are both curved toward the cover 16 such that the finger 64 slides in contact along the arcuate portion 36 of the terminal 32 while the finger 66 slides along a path including the insulating surface of the cover 16 and, at one extreme, the arcuate portion 38 of the terminal 34. In that extreme position the terminals 32 and 34 are shorted by the contactor 62 whereas when the thumbwheel is in any of its other positions there is no circuit connection between the terminal 32 and 34. Thus, the combination of the contactor 62 and the terminals 32 and 34 form a switch which is closed when the thumbwheel is rotated to the position in which the fingers 48 and 60 contact the conductor 44.

When the potentiometer is connected with its terminal 26 and 28 in series with a lighting circuit such as vehicle instrument panel lights, the current passes through the terminal 26, the finger 50 and the fingers 48 to the resistor 40 and then through the conductor 44 to the resistor 42 then through the fingers 60 and 58 to the terminal 28. The resistance in the circuit, of course, is determined by the rotational position of the thumbwheel which is controlled by manual manipulation. The lights, of course, have maximum brightness when the fingers 48 and 60 contact the conductor 44 and the lights gradually dim as the fingers are moved along the resistors 40 and 42. The circuit will be opened and the lamps turned off when the fingers are moved to the extreme position in which they engage the insulating surface of the substrate 12. If the terminals 32 and 34 are connected in series with the courtesy light circuit or dome light of the vehicle, the light is turned on when the thumbwheel is positioned to bridge the fingers 64 and 66 across the arcuate portions 36 and 38 of the terminals; in other positions of the thumbwheel, the circuit is open and the dome or courtesy lights are turned off. The heat generated by the current passing through the resistors 40 and 42 is absorbed into the substrate 12 and dissipated by the fins 14.

Figure 6:
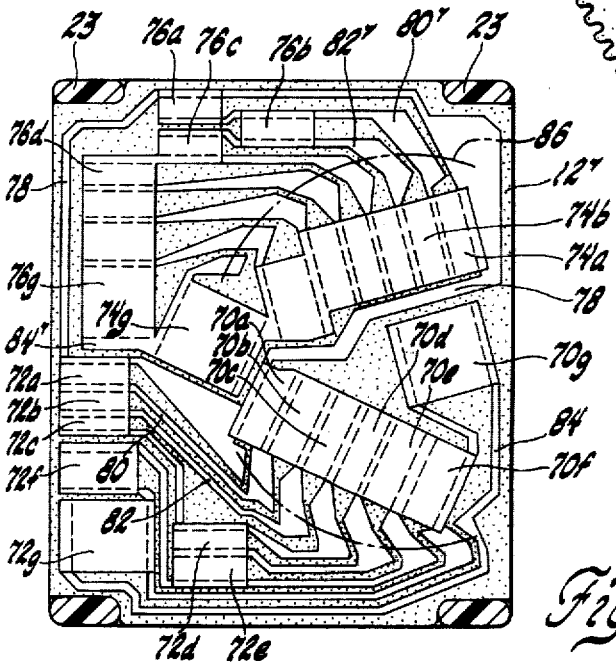
FIG. 6 is an elevational view of the substrate carrying a second embodiment of the printed resistor network.

FIG. 6 shows an alternative resistor configuration for the potentiometer. The substrate 12' has a plurality of rectangular printed resistors distributed throughout the area of the substrate in order to better disseminate the heat generated within the resistors. The resistors are interconnected by conductive pathways containing contact pads grouped in arcuate arrays corresponding to the arcuate path of the contact fingers 48 and 60 during thumbwheel rotation. The substrate 12' contains four serially connected groups of resistors identified as 70*a* through 70*g*, 72*a* through 72*g*, 74*a* through 74*g*, and 76*a* through 76*g*, although some numerals are omitted from the drawing in the interest of clarity. Wherever practical, e.g. resistor 70*a*–70*f*, the series resistors are printed together in a continuous film extending across several conductive pathways. A first conductive pathway 78 contacts one side of each of the printed resistors 70*a*, 72*a*, 74*a* and 76*a*. Each pathway is shown in dotted lines where it passes underneath printed resistor material. A pathway 80 interconnects the junction of resistor 72*a* and 72*b* with the junction of resistors 70*a* and 70*b*. Similarly, a conductor 82 interconnects the junction of resistor 72*b* and *c* with the junctions of resistors 70*b* and *c*. Similar conductive pathways are arranged to interconnect the junctions of the other corresponding resistors of groups 70 and 72 and a conductor 84 finally connects the sides of the resistors 70*g* and 72*g* at the end of their respective groups. Thus, each of the resistors in the groups 70 and 72 are connected in parallel with the corresponding resistor of the other group and connected in series with all the resistors of the same group. Corresponding to the pathways 80, 82 and 84 there are interconnecting portions of the groups 74 and 76, corresponding conductors 80', 82' and 84' as well as other conductors joining corresponding junctions of the resistors so that the corresponding resistors of the groups 74 and 76 are likewise connected in parallel. The conductors each have an enlarged pad which lies on an arc coincident with the path of travel 86 (indicated by broken lines) of the contact fingers on the thumbwheel. When both fingers contact the pathway 78, the fingers and the corresponding terminals 26 and 28 are shorted together. When the thumbwheel is incremented clockwise to connect the contact fingers with the pads on conductors 80 and 80' respectively, the current flows from one of the fingers to the conductor 80 through resistors 70*a* and 72*a* in parallel then through the conductor 78 and then the resistors 74*a* and 76*a* in parallel to the conductor 80' and the other finger, thus establishing a series parallel array of resistors spaced about the substrate 12' so that the heat dissipated therein is widely spread. When the thumbwheel moves, the contact fingers move into contact with the pads on conductors 82 and 82' so that the resistors having the subscript b are serially added to those bearing the subscript a to increase the overall resistance between the contact fingers and therefore the terminals 26 and 28. Additional resistance is added to the effective circuit as the thumbwheel moves counter clockwise until finally the maximum resistance is obtained when the fingers reach the conductors 84 and 84' so that all the resistors on the substrate will be in the series parallel circuit. Thus, when the potentiometer is connected in series with a lighting circuit, the lights can be changed in intensity through several incremental steps upon thumbwheel rotation.

Since the circuit pattern of FIG. 6 does not allow room for a hole for the rivet 22, the thumbwheel is pivoted to the cover by a post which is integrally molded in the cover in the place of the rivet 22. Of course, the first described embodiment of the potentiometer may be modified in the same way. A further modification to the device is that the substrate 12 may comprise a thin wafer of alumina and the heat sink structure be provided separately possibly of another material such as aluminum. Of course, many other modifications of the device may be made within the scope of the invention.

It will thus be seen that the variable resistor device according to the invention provides a compact, easy to manufacture and inexpensive circuit device for the manual selection of resistance, useful, for example, in controlling the light intensity in a light circuit and, in addition, provides a switch for another circuit, the switch and the variable resistance being controlled by a single thumbwheel.

The embodiments of the invention in which an exclusive property or privilege is claimed are defined as follows:

1. A manually adjustable variable resistance control device comprising a housing including an insulating substrate and a mating cover defining a space therebetween, a thumbwheel in the said space pivoted to the housing and partially extending outside the housing for manual rotation, a pair of electrical terminals embedded in the cover each having at one end a connector portion extending outside the housing and at the other end a terminal surface portion exposed at the inner surface of the cover, a resistor circuit comprising a printed resistor pattern on the inner surface of the substrate, and a pair of contactors each carried by the thumbwheel and extending from opposite sides thereof in slidably contacting engagement with one of the terminal surface portions and a selected portion of the resistor circuit to bridge the terminal surface portions and the resistor circuit so that the resistance across the electrical terminals depends upon the manually adjusted position of the thumbwheel.

2. A manually adjustable variable resistance control device comprising a housing including an insulating substrate with means for dissipating heat therefrom and a mating cover defining a space therebetween, a molded plastic thumbwheel in the said space pivoted to the housing and partially extending outside the housing for manual rotation, a pair of electrical terminals embedded in the cover each having at one end a connector portion extending outside the housing and at the other end a terminal surface portion exposed at the inner surface of the cover, a resistor circuit comprising a printed resistor pattern on the inner surface of the substrate, and a pair of contactors each having a portion molded in the thumbwheel and integral fingers extending from opposite sides thereof in slidably contacting engagement with one of the terminal surface portions and a selected portion of the resistor circuit to bridge the terminal surface portions and the resistor circuit so that the resistance across the electrical terminals depends upon the manually adjusted position of the thumbwheel.

3. A manually adjustable variable resistance control device comprising a housing including an insulating substrate and a mating cover defining a space therebetween, a thumbwheel in the said space pivoted to the housing and partially extending outside the housing for manual rotation, a pair of electrical terminals embedded in the cover each having at one end a connector portion extending outside the housing and at the other end a terminal surface portion exposed at the inner surface of the cover, a resistor circuit on the inner surface of the substrate comprising first and second printed resistor patterns and a printed conductor connecting the resistor patterns in series, and a pair of contactors each carried by the thumbwheel and extending from opposite sides thereof in slidably contacting engagement with one of the terminal surface portions and one of the resistor patterns to connect a variable part of the resistor circuit across the terminals so that the resistance across the electrical terminals depends upon the manually adjusted position of the thumbwheel.

4. A manually adjustable variable resistance control device in combination with an electrical switch comprising a housing including an insulating substrate and a mating cover defining a space therebetween, a thumbwheel in the said space pivoted to the housing and partially extending outside the housing for manual rotation, first and second pairs of electrical terminals embedded in the cover each terminal having at one end a connector portion extending outside the housing and at the other end a terminal surface portion exposed at the inner surface of the cover, a resistor circuit comprising a printed resistor pattern on the inner surface of the substrate, a pair of contactors each carried by the thumbwheel and extending from opposite sides thereof in slidably contacting engagement with one of the first pair of terminal surface portions and a selected portion of the resistor circuit to bridge the terminal surface portions and the resistor circuit so that the resistance across the electrical terminals depends upon the manually adjusted position of the thumbwheel, and a further contactor carried by the thumbwheel and extending toward the cover and movable in a path for selectively bridging the terminal surface portions of the second pair of terminals thereby defining a switch operated by the thumbwheel.

* * * * *